US007997036B1

(12) United States Patent
Motosko et al.

(10) Patent No.: US 7,997,036 B1
(45) Date of Patent: Aug. 16, 2011

(54) CORRUGATED HURRICANE WINDOW PANEL ATTACHMENT SYSTEM AND METHOD

(76) Inventors: Stephen J. Motosko, Sarasota, FL (US); Stephen J. Motosko, III, Sarasota, FL (US)

( * ) Notice: Subject to any disclaimer, the term of this patent is extended or adjusted under 35 U.S.C. 154(b) by 319 days.

(21) Appl. No.: 12/215,547

(22) Filed: Jun. 27, 2008

(51) Int. Cl.
*E06B 3/26* (2006.01)

(52) U.S. Cl. ..... 52/202; 49/57

(58) Field of Classification Search ..... 52/202, 52/203; 49/50, 57, 463, 464
See application file for complete search history.

(56) References Cited

U.S. PATENT DOCUMENTS

| | | | | | |
|---|---|---|---|---|---|
| 2,598,610 | A | | 5/1952 | Satz et al. | |
| 2,742,679 | A | * | 4/1956 | Young | 49/463 |
| 3,887,966 | A | * | 6/1975 | Gley | 24/68 CD |
| 3,938,660 | A | * | 2/1976 | Moehring | 206/451 |
| 4,406,320 | A | * | 9/1983 | Bingham | 160/370.21 |
| 4,848,825 | A | * | 7/1989 | Niernberger | 296/95.1 |
| 4,960,353 | A | * | 10/1990 | Thorndyke | 410/20 |
| 5,457,921 | A | * | 10/1995 | Kostrzecha | 52/202 |
| 5,595,233 | A | * | 1/1997 | Gower | 160/232 |
| 5,713,624 | A | * | 2/1998 | Tower | 296/152 |
| 5,879,048 | A | * | 3/1999 | Tower | 296/152 |
| 6,161,605 | A | | 12/2000 | Pena | |
| 6,330,768 | B1 | | 12/2001 | Rodrigues | |
| 6,745,522 | B2 | * | 6/2004 | Germain | 52/202 |
| 6,868,642 | B2 | * | 3/2005 | Madden | 52/202 |
| 6,907,710 | B2 | | 6/2005 | Trundle | |
| 6,974,622 | B2 | * | 12/2005 | Wade | 428/182 |
| 7,100,329 | B2 | | 9/2006 | Pleasants | |
| 7,325,365 | B2 | * | 2/2008 | Warner | 52/203 |
| 2006/0288646 | A1 | * | 12/2006 | Pleasants | 49/465 |
| 2007/0193137 | A1 | * | 8/2007 | DeBoth | 52/202 |
| 2008/0034671 | A1 | * | 2/2008 | Harrington | 52/2.26 |
| 2009/0151276 | A1 | * | 6/2009 | Debes, Jr. | 52/203 |
| 2009/0249715 | A1 | * | 10/2009 | Germain et al. | 52/202 |

* cited by examiner

*Primary Examiner* — Robert J Canfield
*Assistant Examiner* — Brent W Herring
(74) *Attorney, Agent, or Firm* — Gifford, Krass, Sprinkle, Anderson & Citkowski, P.C.

(57) ABSTRACT

A corrugated hurricane panel attachment and strengthening strap system and method for enhanced storm protection for a window of a building. A pair of attaching brackets are each entrappingly connectable along opposing upright edges of the corrugated panel and to the corresponding window frame to hold the upright edges of the panel protectively over the outside of the window. An elongated flexible strap is extendable across the front and rear faces of the panel and is supported through and tensioned against spaced slots formed through each of the brackets, the slots being spaced apart a distance similar to a thickness of the panel. The ends of the strap are lockingly engagable one to another under tension wherein the strap bears against an outer surface of the corrugations of the panel for added panel strength.

13 Claims, 2 Drawing Sheets

CORRUGATED HURRICANE WINDOW PANEL ATTACHMENT SYSTEM AND METHOD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to window protective systems and methods for preventing window damage during wind storms and hurricanes, and more particularly to a system and method for attaching and strengthening a corrugated hurricane panel for window protection.

2. Description of Related Art

A wide variety of devices and systems have been developed to enhance the protection afforded windows and doors of buildings during intense storms and hurricanes. Intense wind and flying objects during tropical storms and hurricanes can easily damage windows, leading to the total destruction of a building. In addition to well known method of attaching corrugated hurricane panels to window frames to cover the window, hurricane shutters and rollaway shutters have also become well known as one means of protecting windows and doors, these apparatus being deployable prior to the building experiencing tropical storm or hurricane force winds.

A number of additional patented systems are known to serve the same purpose of protecting the windows from storm and wind damage. U.S. Pat. No. 6,330,768 to Rodrigues teaches a window storm panel brace having one or more elongated braces or bars that extend from one wall of the window opening to an opposed wall. The elongated brace is further provided with a planar friction pad at each end which is angularly adjustable relative to the long axis of the body to conform to the angle of the wall for maximum contact.

Pleasants teaches a universal attachment for installing and bracing covers over building openings in U.S. Pat. No. 7,100,329. An object of the '329 patent is to generate a tensile latching force via a commercially available ratchet attached to lightweight straps. U.S. Pat. No. 6,907,710 to Trundle teaches a method of securing a framed panel made of polycarbonate material over a window and secured thereto by shock cords and a cleat attached to the frame.

U.S. Pat. No. 2,598,610 to Satz, et al. teaches a storm shutter assembly for protecting a window during violent storms comprising a rigid panel utilizing stiles and keepers to hold the panel against the opening. Pena teaches a foldable device for protecting windows comprising two protective panels with hinges attached between the front surfaces of adjacent panels in U.S. Pat. No. 6,161,605. Straps are utilized to attach the back surfaces of the endmost panels and include a quick-release fastener.

The present invention provides a corrugated hurricane panel attachment and security/strengthening strap system and method for enhanced protection of windows and doors from the damaging effects of high wind and impact during hurricanes and tropical storms. Unique attaching brackets are provided which entrap both edges of the corrugated panel while an elongated flexible strap extends around and through each of the brackets and against both sides of the corrugated panel for added strength.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This disclosure is directed to a corrugated hurricane panel attachment and security strap system and method for enhanced storm protection for a window of a building. A pair of attaching brackets are each entrappingly connectable along opposing upright edges of the corrugated panel and to the corresponding window frame to hold the upright edges of the panel protectively over the outside of the window. An elongated flexible strap is extendable across the front and rear faces of the panel and is supported through and tensioned against spaced slots formed through each of the brackets, the slots being spaced apart a distance similar to a thickness of the panel. The ends of the strap are lockingly engagable one to another under tension wherein the strap bears against an outer surface of the corrugations of the panel for added panel strength.

It is therefore an object of this invention to provide a corrugated hurricane panel attachment and security/strengthening strap system.

Yet another object of this invention is to provide a system for attaching and strengthening corrugated polycarbonate hurricane panels onto the window frame protectively over a window or door.

Still another object of this invention is to provide a unique attaching bracket for securing a corrugated hurricane panels protectively over a window.

And a still further object of this invention is to provide an improved method of covering a window for storm protection against a window frame and over the window.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
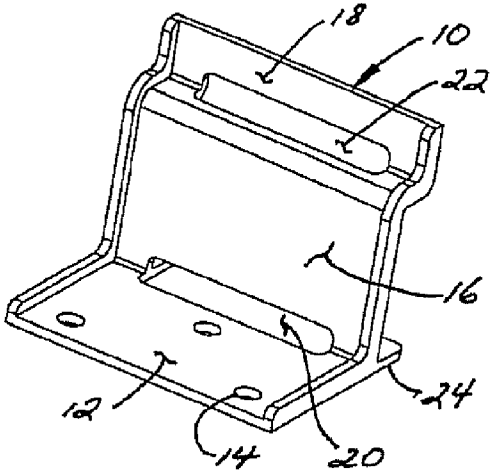
FIG. 1 is a perspective view of the attaching bracket for a corrugated hurricane panel attachment and security strap system.
Figure 2:
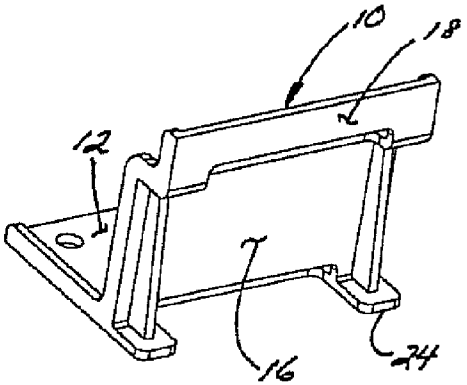
FIG. 2 is another perspective view of FIG. 1.
Figure 3:
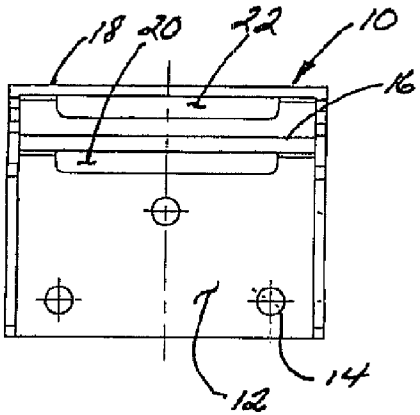
FIG. 3 is a top plan view of FIG. 1.
Figure 4:
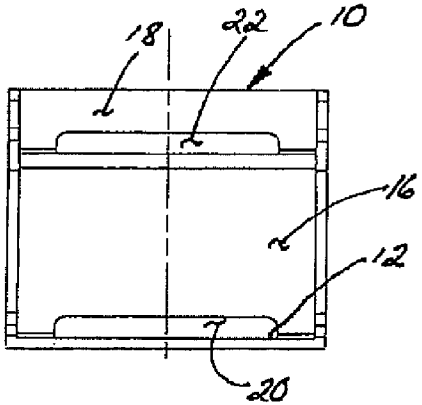
FIG. 4 is a bottom plan view of FIG. 1.
Figure 5:
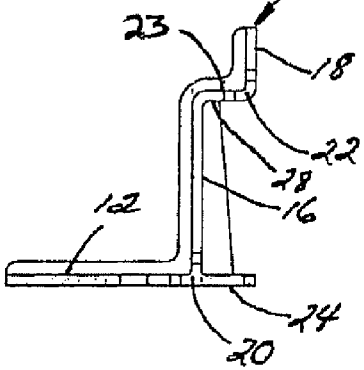
FIG. 5 is a side elevation view of FIG. 1.
Figure 6:
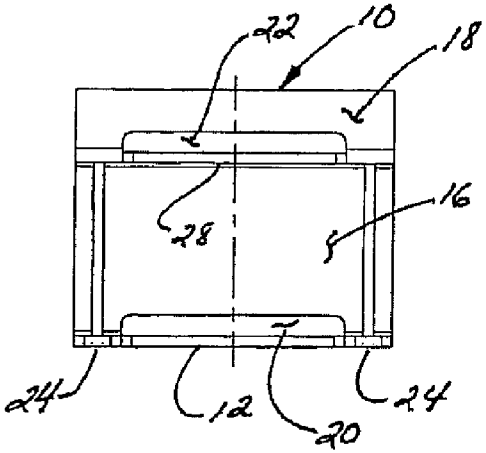
FIG. 6 is a rear elevation view of FIG. 1.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring now to the drawings, and firstly to FIGS. 1 to 6, the preferred embodiment of the multi-function strap anchor or bracket is there shown generally at numeral 10 and is formed as a unit by either machining or preferably by aluminum injection molding. The bracket 10 includes a flat base 12 having mounting apertures 14 formed therein for attachment against a window frame as described herebelow. A standoff panel 16 orthogonally extends from a proximal edge of the base plate 12, stabilizing tabs 24 being coextensive with the base plate 12 and extending beyond the standoff panel 16.

An offset panel 18 upwardly extends from an offset portion 28 positioned between the distal edge of the standoff panel 16 and the offset panel 18. An elongated slot 22 is formed along a substantial length of the panels 16 and 18 between the offset 28 and the offset panel 18. The offset 28 has a surface portion 23 for bearing a flexible strap 42. Another elongated slot 20 is formed between the junction of base plate 12 and the standoff panel 16.

Each of the side margins of the base plate 12 and panels 16 and 18 include stiffening ribs for adequately restraining and maintaining the steady tension placed upon each pair of brackets 10 as will be appreciated more fully herebelow. Likewise, the strengthening gusset extending from the tabs 24 along the side margins of the standoff panel 16 add to the overall strength and rigidity of the bracket 10.

Figures 7, 8, 9:
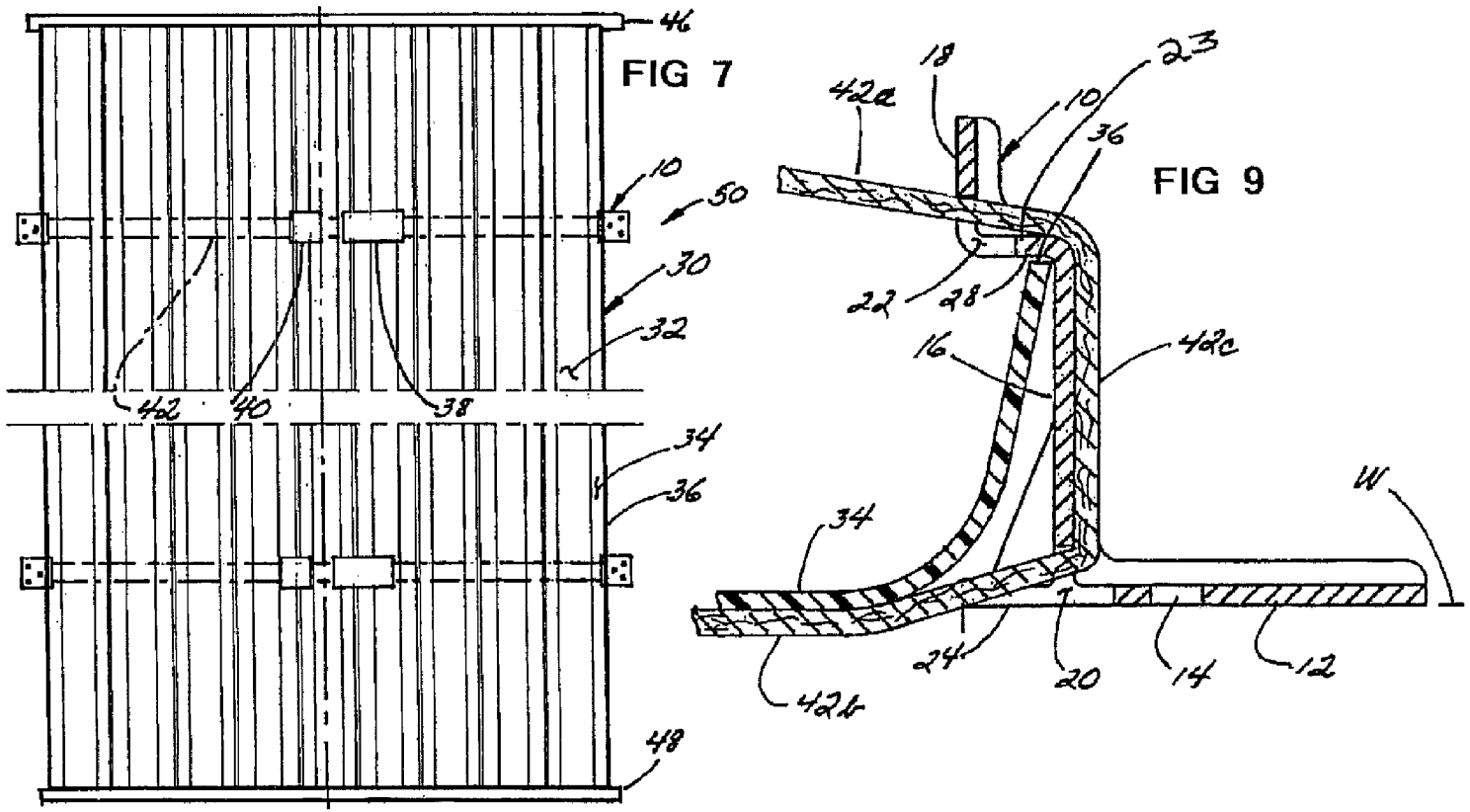
FIG. 7 is a front elevation view of the corrugated hurricane panel attachment and security strap system.
FIG. 8 is a top plan view of FIG. 7.
FIG. 9 is an enlarged cross section view of the right end portion of FIG. 8.

Referring additionally to FIGS. 7 to 9, a typical storm and hurricane shutter installation over a window is there shown generally at numeral 50 and includes two pairs of brackets 10 previously described. This shutter installation 50 also includes a corrugated preferably polycarbonate transparent storm shutter 30 formed as a unit having a plurality of offset corrugations 32 and 34 as best seen in FIG. 8. The upper and lower margins of the corrugated panel 30 are supported by conventional headers 46 and 48 in a well-known manner.

However, the brackets 10 are a multifunction for not only restraining the side margins 36 of the corrugated panel 30, but also for supporting and resisting tension applied via an encircling support strap 42. Additionally, these brackets 10 provide a spaced relation between the standoff panel 16 and the placement of the outer slot 22 previously described. Moreover, the offset 28 also bears against the edge margin 36 of the corrugated panel 30 as best seen in FIG. 9. The edge margins 36 are positioned generally with respect to the outermost corrugation 34 so as to have a width generally equal to the spacing between the inner surface of the base plate 12 and the opposing surface of offset 28. By positioning each of the brackets 10 as shown in FIG. 9 and anchoring them securely by threaded fasteners through mounting apertures 14 into the window frame W on either edge 36 of the corrugated panel 30, the corrugated panel 30 is laterally restrained and prevented from substantial buckling or distortion of these edge corrugations 34 thereby.

To add wind and impact resistance to the central portion of the corrugated panel 30 and for further restraint of panel 30, an elongated flexible strap 42 having mating tensionable end buckle portions 38 and 40 is passed through the slots 20 and 22 of each of the pairs of brackets 10. Strap portion 42*a* as best seen in FIGS. 8 and 9 passes between slots 22 and, when tensioned, bears against the outwardly facing corrugations 32 while strap portion 42*b* bears against the inwardly facing corrugations 34. After proper tensioning of the strap 42 by adjustment between buckle portions 38 and 40, the tensioning force is resisted and maintained between the pairs of brackets 10 with the belt portion 42*c* bearing against the standoff panel 16 as best seen in FIG. 9.

As will be better now understood, the addition of the flexible belt strap 42 as previously described, depending upon the spatial separation between the slots 20 and 22 of bracket 10, will position either or both of the spans 42*a* and 42*b* of the flexible belt 42 against the corresponding corrugations 32 and 34, respectively of the corrugated panel 30. Thus, the spacing between the slots 20 and 22 is preferably generally similar to the overall thickness of the corrugated panel 30. However, by narrowing the spacing between the slots 20 and 22 to be somewhat less than that of the thickness of the corrugated panel 30, additional resistance to flexing and impact distortion of the corrugated panel 30 is thereby provided as best understood in FIG. 8.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A hurricane security system for a window of a building, said system comprising:

a panel having an inner surface, an outer surface, and a pair of side edges, the panel covering the window;

a pair of brackets mounted to the building, each of the pair of brackets mounted adjacent a respective one of the side edges of the panel;

a flexible strap having a pair of ends, said strap encircling said panel and a portion of said brackets such that the strap passes continuously over the outer surface and continuously outside of the inner surface and over a portion of each of said brackets, said strap contacting the outer surface and the inner surface, the ends of said straps connected to each other along either the inner surface or the outer surface of the panel.

2. The system of claim 1, wherein each of the pair of brackets comprise a first slot and the strap passes through the first slot.

3. The system of claim 2, wherein each bracket comprises a surface portion spaced apart from the first slot, the strap passing over the surface portion and through the first slot.

4. The system of claim 3, wherein the panel has a predetermined thickness and the distance between the surface portion and the first slot of the bracket is generally equal to the predetermined thickness of the panel.

5. The system of claim 4, wherein a second slot is at least partially formed in the surface portion of the bracket.

6. The system of claim 3, wherein the bracket further includes a base plate and a standoff panel, the base plate extends generally coplanar with the panel and said standoff panel extends generally normal from the base plate.

7. The system of claim 6, wherein the first slot is formed at a junction between the base plate and the standoff panel.

8. The system of claim 7, wherein said surface portion is formed on an offset portion which extends generally normal from an end of said standoff panel opposite from said base plate.

9. The system of claim 6, wherein said surface portion is formed on an offset portion, said offset portion extends generally normal from an end of said standoff panel opposite said base plate, and wherein said side edges of said panel abut said offset portion.

10. The system of claim 9, wherein said side edges of said panel abut said offset portion on a side opposite said surface portion.

11. The system of claim 10, wherein said panel has a predetermined thickness and the distance between the offset portion and the first slot of the bracket is generally equal to the predetermined thickness of the panel.

12. The system of claim 11, wherein a second slot is at least partially formed in the surface portion of the bracket.

13. The system of claim 12, wherein the first slot is formed at a junction between said base plate and the standoff panel.

* * * * *